US006200528B1

(12) United States Patent
Rodney et al.

(10) Patent No.: US 6,200,528 B1
(45) Date of Patent: Mar. 13, 2001

(54) COBALT FREE HIGH SPEED STEELS

(75) Inventors: Mark S. Rodney, Pittsburgh; James L. Maloney, III, Greensburg, both of PA (US); George Waid, Orwell, OH (US)

(73) Assignee: Latrobe Steel Company, Latrobe, PA (US)

( * ) Notice: Subject to any disclaimer, the term of this patent is extended or adjusted under 35 U.S.C. 154(b) by 0 days.

(21) Appl. No.: 09/156,727

(22) Filed: Sep. 17, 1998

Related U.S. Application Data

(60) Provisional application No. 60/059,143, filed on Sep. 17, 1997.

(51) Int. Cl.[7] ..... C22C 38/22; C22C 38/24; C22C 38/28

(52) U.S. Cl. ..... 420/110; 420/111; 420/101

(58) Field of Search ..... 420/111, 110, 420/101

(56) References Cited

U.S. PATENT DOCUMENTS

| | | | | |
|---|---|---|---|---|
| 2,343,069 | * | 2/1944 | Luerssen et al. | 420/111 |
| 3,850,621 | | 11/1974 | Haberling et al. | 75/126 A |
| 3,901,690 | | 8/1975 | Philip et al. | 75/123 H |
| 4,116,684 | | 9/1978 | Uchida et al. | 75/126 C |
| 4,224,060 | | 9/1980 | de Souza et al. . | |

FOREIGN PATENT DOCUMENTS

| | | | | |
|---|---|---|---|---|
| 585799 | | 12/1972 | (CH) . | |
| 1271409 | | 11/1962 | (DE) . | |
| 0105861 | | 9/1983 | (EP) . | |
| 0265528 | | 4/1987 | (EP) . | |
| 0264528 | | 4/1988 | (EP) . | |
| 0630984 | | 5/1994 | (EP) . | |
| 2096171 | | 10/1982 | (GB) . | |
| 57-143468 | * | 9/1982 | (JP) | 420/111 |
| 60-208457 | | 10/1985 | (JP) . | |
| 86021299 | | 5/1986 | (JP) . | |
| 86036070 | | 6/1986 | (JP) . | |
| 61-213350 | | 9/1986 | (JP) . | |
| 91023617 | | 3/1991 | (JP) . | |
| 91033776 | | 5/1991 | (JP) . | |
| 561748 | | 6/1977 | (SU) . | |
| 1113423 | | 9/1984 | (SU) . | |
| 1463793 | | 7/1989 | (SU) . | |
| 1463797 | | 7/1989 | (SU) . | |
| WO9302818 | | 2/1993 | (WO) . | |
| WO9524513 | | 9/1995 | (WO) . | |

* cited by examiner

*Primary Examiner*—Deborah Yee
(74) *Attorney, Agent, or Firm*—Webb Ziesenheim Logsdon Orkin & Hanson, P.C.

(57) ABSTRACT

An alloy steel having the capability of retaining high hardness at elevated temperature for a prolonged time is suitable for use as a high speed tool steel. The alloy steel comprises in % by weight: 0.7–1.4 C; less than 1 Mn; less than 0.04 P; up to 0.7 Si; 3–6 Cr; 4–12 Mo; less than 0.5 Co; 0.5–2.25 V; 1–7 W; up to 1.25 Al; at least one of 0.04–2.5 Nb; 0.025–2.5 Zr; 0.08–4.75 Ta and 0.005–0.7 Ti; balance substantially Fe. The alloy may also have an S content of 0.036–0.300; Mn of 0.30–1.35 and may optionally be treated when in a liquid state with up to 0.05 of Mg or Ca.

6 Claims, No Drawings

COBALT FREE HIGH SPEED STEELS

CROSS REFERENCE TO RELATED APPLICATION

This application claims the benefit of earlier filed U.S. Provisional Patent Application Ser. No. 60/059,143, filed Sep. 17, 1997, entitled "Cobalt Free High Speed Steels".

BACKGROUND OF THE INVENTION

The present invention relates generally to the art of metallurgy and, more particularly, to high speed tool steels.

High speed steels are composite materials that contain a variety of alloy carbide particles in an iron base plus, depending on the heat treatment, various atomic arrangements of iron carbon in the form of austenitic, ferritic, bainltic and martensitic structures. Various carbide forming elements such as, for example, chromium, molybdenum, tungsten and vanadium, are constituents of high speeds. Infrequently, niobium and titanium are used as additional carbide forming elements. These above enumerated elements are found combined as carbides as the result of ledeburitic and eutectoid reactions as the molten alloy solidifies and transformation as the temperature drops. Silicon is normally present and higher levels may be added to the alloy to increase attainable hardness.

Because of the high temperatures produced during machining more difficult materials, the retention of the critical cutting surfaces is related to the hardness of the tool. The ability of the tool to retain its hardness is assessed by the hardness of the tool at elevated temperatures. Retention of the hardness can be measured by testing the steel at a given temperature or heating the steel for a prolonged time at a given temperature then measuring the steel's retention of hardness at room temperature when the tool cools down. The present invention improves the hot hardness properties of high speed steel without the use of cobalt or very high tungsten and/or molybdenum combinations. Cobalt is not only expensive but its supply is irregular and the use of very high tungsten and molybdenum combinations produce steels that are difficult to hot work without utilizing costly powder metallurgy methods.

The present invention provides a family of high speed steel compositions that have the capability of achieving high hardness upon proper hardening and retaining a significant portion of that property at temperatures commonly encountered by cutting tools such as drills, taps and reamers. These steels are also useful in operations that require high hardness at more moderate to room temperature operations such as punches and thread forming tools.

SUMMARY OF THE INVENTION

The present invention is directed to an alloy steel having the capability of retaining high hardness at elevated temperature for a prolonged time. The alloy steel is suitable for use as a high speed tool steel and broadly comprises in % by weight: 0.7–1.4 C; less than 1 Mn; less than 0.04 P; up to 0.7 Si; 3–6 Cr; 4–12 Mo; less than 0.5 Co; 0.5–2.25 V; 1–7 W; up to 1.25 Al; at least one of 0.04–2.5 Nb; 0.25–2.5 Zr; 0.08–4.75 Ta; and at least one of 0.005–0.7 Ti; 0.025–1.4 Zr; balance Fe. The alloy may also have an S content of 0.036–0.300; and Mn of 0.30–1.35 and may optionally be treated when in a liquid state with up to 0.05 of Mg or Ca.

DETAILED DESCRIPTION OF THE INVENTION

The present invention provides a high speed steel similar to the popular types such as AISI M-2 with the hot hardness properties similar to AISI M-42. Since the hardness and other physical properties of high speed steels are related to their heat treatment, carbide size, distribution and composition, the theoretical phases of high speed steels were examined through the calculations of Thermo Calc® (a registered tradermark of Thermo-Calc AB) a software program that utilizes known thermodynamic values of the constituent elements to predict phase formation. Initially, a fractionated factorial experiment was designed based on the concept that small, primary, MC carbides would resist softening. As AISI M-2 high speed was chosen as a base, the carbon, tungsten, vanadium and molybdenum levels were varied with the addition of varying amounts of niobium and aluminum The niobium was added to combine with the carbon as a source of carbides stable at high temperatures. Whilst the aluminum was added as a means of improving the hot hardness of the alloy since it retards softening, it was also added since it enhances the stability of the ferrite and modifies the morphology of niobium carbide particles. The modification of the niobium carbide morphology is affected by aluminum because it reduces the activity of carbon in the melt and in the austenite. If the niobium combines to form carbides in the form of $M_6C$, these will be large blocky particles. Large blocky particles are less desirable than smaller fine particles which are type formed when the niobium forms $M_2C$ type carbides. The use of aluminum to improve hot hardness properties of high speed steels and M-2 grade in particular has been used in the past, particularly at concentrations around one weight percentage. Aluminum, however, reduces the solidus temperature substantially and thus causes difficulties in heat treating because it limits the ability to use very high austenitizing temperatures for maximum hardening response. Aluminum also increases the carbide content that precipitates during secondary hardening brought out by tempering at intermediate temperatures. Heat treated hardness is also improved by the addition of aluminum since it decreases the amount of retained austenite. Aluminum is critical in the present invention and preferably added up to 1.25 wt. %. Smaller amounts of aluminum, in the range of 0.025 to 0.25, are effective in obtaining the desired properties.

Although silicon also increases temper hardness, it also drastically lowers hardening temperatures as the liquidus and solidus temperatures. Silicon can replace tungsten, molybdenum and vanadium in the matrix and raise the solubility of carbon in the matrix. These changes cause a higher quenched hardness, but this effect decreases in the presence of nitrogen. Nitrogen is typically present in high speed tool steels in concentrations of 0.01 to 0.08%. Nitrogen raises the tempered hardness and it causes the primary, MC carbides, to be globular in shape.

Niobium readily forms carbide particles. These particles form as the metal solidifies in the form, MC, that is noted as good for wear resistance. Niobium decreases the solubility of carbon in austenite and the lower carbon content of the austenite matrix results in higher martensite transformation start temperature. These higher martensite start temperatures favor less retained austenite. The addition of niobium and consequent formation of niobium carbide particles result in higher hardening temperatures. The formation of niobium carbide particles is favored, as measured by the free energy at elevated temperatures, over the formation of other common carbide compounds such as vanadium, molybdenum, tungsten and chromium carbides.

An experiment was designed to examine the effects of variations of six elements, carbon, tungsten, niobium, vanadium, aluminum and molybdenum on a high speed steel of the composition of AISI M-2 steel. Chromium was set for an aim of 3.75 wt. %, silicon at 0.35%, manganese at 0.32%, phosphorus at 0.015% maximum, sulphur at 0.005%, nickel at 0.16% with no additions of cobalt or titanium. A series of trail ingots based on a fractionated factorial was melted in a 100 pound vacuum induction furnace then cast into round molds which were rolled to bar for evaluation. An additional alloy in the middle of the factorial design composition range was also melted, alloy number 17. The initial heats to be melted had the following aim compositions.

Factorial Experimental Design: Chemical Composition

| Heat | C | W | Nb | V | Al soluble | Mo |
|---|---|---|---|---|---|---|
| 1 | .85 | 1.60 | .10 | .90 | none | 5.00 |
| 2 | 1.18 | 1.60 | .10 | .90 | 1.00 | 5.00 |
| 3 | .85 | 6.00 | .10 | .90 | 1.00 | 10.50 |
| 4 | 1.18 | 6.00 | .10 | .90 | none | 5.00 |
| 5 | .85 | 1.60 | 1.60 | .90 | 1.00 | 10.50 |
| 6 | 1.18 | 1.60 | 1.60 | .90 | none | 10.50 |
| 7 | .85 | 6.00 | 1.60 | .90 | none | 5.00 |

-continued

Factorial Experimental Design: Chemical Composition

| Heat | C | W | Nb | V | Al soluble | Mo |
|---|---|---|---|---|---|---|
| 8 | 1.18 | 6.00 | 1.60 | .90 | 1.00 | 5.00 |
| 9 | .85 | 1.60 | .10 | 1.80 | none | 10.50 |
| 10 | 1.18 | 1.60 | .10 | 1.80 | 1.00 | 10.50 |
| 11 | .85 | 6.00 | .10 | 1.80 | 1.00 | 5.00 |
| 12 | 1.18 | 6.00 | .10 | 1.80 | none | 5.00 |
| 13 | .85 | 1.60 | 1.60 | 1.80 | 1.00 | 5.00 |
| 14 | 1.18 | 1.60 | 1.60 | 1.80 | none | 5.00 |
| 15 | .85 | 6.00 | 1.60 | 1.80 | none | 10.50 |
| 16 | 1.18 | 6.00 | 1.60 | 1.80 | 1.00 | 10.50 |
| 17 | 1.02 | 3.80 | .85 | 1.35 | .50 | 7.75 |

The proposed alloys were examined for predicted equilibrium phases and transformations from the liquid state via Thermo Calc®.

Theoretic Predio Phases and Critical Temperatures Thermo Calc® of Initial Factorial Experiment Theoretical Prediction Phases and Critical Temperatures from Thermo Calc ® of Initial Factorial Experiment

| Alloy | Liquidus ° F. | Solidus ° F. | Anstenite to Ferrite ° F. | % Ferrite | $M_{23}C_6$ | $M_6C$ | $M_2C$ | MC |
|---|---|---|---|---|---|---|---|---|
| 1 | 2588 | 2243 | 1514–1473 | 84 | 10.1% | 4.8% | — | 1.0% |
| 2 | 2582 | 2142 | 1764–1554 | 77.4 | 17.5 | 3.3 | — | 1.9 |
| 3 | 2594 | 2269 | 2060–1688 | 72.9 | 5.8 | 20.85 | — | .35 |
| 4 | 2531 | 2206 | 1497–1444 | 74 | 13.6 | 9.2 | 1.6% | 1.7 |
| 5 | 2586 | 2305 | 2305–1643 | 78.2 | 3.6 | 15.9 | — | 2.4 |
| 6 | 2518 | 2285 | 1534–1487 | 74 | 9.3 | 13.6 | — | 3.0 |
| 7 | 2565 | 2359 | 1540–incomplete | 81.6 | 3.1 | 12.2 | — | 3.1 |
| 8 | 2603 | 2243 | 1883–1472 | 77.1 | 8.6 | 10.5 | — | 3.8 |
| 9 | inc. | 2338 | 1631–1523 | 78.6 | 3.9 | 15.6 | — | 2.0 |
| 10 | 2552 | 2269 | 2240–1634 | 76.3 | 6.7 | 13.4 | — | 3.6 |
| 11 | inc. | 2271 | 2265–1660 | 79.7 | 5.2 | 12.8 | — | 2.2 |
| 12 | 2522 | 2109 | 1472–1373 | 68.0 | 17.4 | 12.4 | — | — |
| 13 | 2612 | 2140 | no anstenite | 85.4 delta | 3.4 | 7.2 | — | 4.1 |
| 14 | 2526 | 2274 | 1552–1489 | 81.5 | 8.7 | 4.8 | — | 4.8? |
| 15 | 2543 | 2348 | 2337–1763 | 73.8 | 0 | 22.1 | — | 4.0 |
| 16 | 2533 | 2241 | no anstenite | 73.1 | 0 | 14.2 | 12.5 | 0 |
| 17 | 2562 | 2233 | 1746–1575 | 81.2 | .6 | 5.5 | 12.7 | 0 |
| M42* | 2512 | 2212 | 1572–1532 | 77.4 | 9.4 | 11.2 | 0 | 2.4 |
| M42 | 2508 | 2212 | 1592–1555 | 80.6 | 3.7 | 5.8 | 8.3 | 1.5 |
| M-2 | inc. | 2284 | 1526–1472 | 79.2 | 6.7 | 12.1 | — | 1.9 |

-continued

Theoretical Prediction Phases and Critical Temperatures from Thermo Calc ® of Initial Factorial Experiment

| Alloy | Liquidus ° F. | Solidus ° F. | Anstenite to Ferrite ° F. | % Ferrite | $M_{23}C_6$ | $M_6C$ | $M_2C$ | MC |
|---|---|---|---|---|---|---|---|---|
| M2 + 1% Al | | 2063 | no gamma | 77.6 delta | 8.9 | 10.6 | — | 3.0 |

*no nitrogen

The ingots were rolled to approximately 1.25×4" flats. Samples were cut from wrought bars from each trial heat. These pieces were then austenitized at a range of temperatures from 2125–2175° F. Rockwell "C" hardness, "HRC", was measured after quenching from the austenitizing temperature then again following each two hour tempered cycle. The pieces were austenitized at three or more different temperatures set in the range 2125–2175° F. then tempered over a range of temperatures from 932–1067° F.

Chemical Composition and Heat Treat Response of Initial Melts

| Melt | C | W | V | Mo | Al soluble | Nb | Maximum Hardness HRC | Austenitize Temperature ° F. | Temper Temperature ° F. |
|---|---|---|---|---|---|---|---|---|---|
| 645 | .82 | 1.58 | .87 | 5.27 | .024 | .13 | 66.8 | 2120 | 999 |
| 647 | | | | | | | | | |
| 653 | 1.03 | 1.55 | .87 | 5.30 | 1.07 | .10 | 63.1 | 2120 | 1067 |
| 656 | .92 | 1.71 | .93 | 10.70 | 1.18 | 1.69 | 58.2 | 2145 | 932 |
| 677 | 1.19 | 1.71 | .89 | 10.71 | .031 | 1.72 | 66.0 | 2145 | 1067 |
| 657 | 1.20 | 1.81 | .90 | 10.97 | .086 | 1.66 | 65.9 | 2120 | 999 |
| 673 | .87 | 6.08 | .85 | 5.28 | .034 | 1.61 | 65.0 | 2145 | 999 |
| 646 | .75 | 5.60 | .78 | 4.85 | .193 | 1.59 | 64.1 | 2145 | 999 |
| 648 | | | | | | | | | |
| 674 | 1.18 | 6.10 | .83 | 5.27 | .033 | .10 | 65.9 | 2120 | 1067 |
| 658 | 1.22 | 6.58 | .88 | 5.30 | .105 | 1.55 | 65.9 | 2145 | 1067 |
| 662 | .86 | 1.69 | 1.71 | 5.10 | .82 | 1.55 | 63.0 | 2145 | 932 |
| 678 | 1.17 | 1.68 | 1.68 | 5.27 | .026 | 1.69 | 64.4 | 2145 | 999 |
| 663 | 1.19 | 1.72 | 1.55 | 5.18 | .82 | 1.51 | 66.3 | 2120 | 999 |
| 651 | .77 | 1.88 | 1.88 | 11.69 | .029 | .16 | 63.5 | 2145 | 999 |
| 660A | 1.14 | 1.72 | 1.60 | 10.95 | .90 | .096 | 66.6 | 2120 | 999 |
| 659 | | | | | | | 66.5 | 2145 | 999 |
| 661 | .86 | 6.14 | 1.73 | 5.34 | .85 | .10 | 66.6 | 2145 | 999 |
| 660B | | | | | | | 65.2 | 2145 | 932 |
| 675 | 1.23 | 6.25 | 1.69 | 5.30 | .035 | .10 | 67.4 | 2145 | 1067 |
| 650 | 1.12 | 6.00 | 1.50 | 5.20 | .112 | .11 | 66.9 | 2145 | 1067 |
| 654 | .95 | 6.31 | .82 | 11.02 | 1.24 | .11 | 65.0 | 2145 | 932 |
| 676 | .87 | 6.11 | 1.72 | 10.72 | .060 | 1.60 | 56.3 | 2145 | 999 |
| 652 | .75 | 8.28 | 1.63 | 10.98 | .174 | 2.01 | 24.2 | 2145 | 1067 |
| 665 | 1.03 | 3.86 | 1.22 | 8.03 | .41 | .90 | 66.5 | 2145 | 999 |

Heat Treat Response with 2175° F. Austenitize Temperature and 932° F. Temper

| Melt | Hardness - HRC after 3 Tempers | Melt | Hardness - HRC after 3 Tempers |
|---|---|---|---|
| 645 | 64.9 | 657 | 65.9 |
| 650 | 66.1 | 658 | 65.5 |
| 654 | 65.1 | 663 | 66.4 |
| 660 | 66.6 | 665 | 66.1 |

-continued

| Melt | Hardness - HRC after 3 Tempers | Melt | Hardness - HRC after 3 Tempers |
|---|---|---|---|
| 661 | 64.4 | 673 | 64.3 |
| 674 | 60.5 | 677 | 65.1 |
| 675 | 66.0 | | |

A comparison of the heat treat response with the theoretical phase composition predicted by Thermo Calc® did not show a positive correlation of hardness with $M_2C$ particles. Wrought samples from the most promising heats plus a sample of AISI M-42 high speed were quenched and tempered, then aged at elevated temperatures, then air cooled to room temperature to determine their retained hardness.

Percentage Retained Hardness—HRC of Selected Melts

| Melt | 32 hours at 700 °F. | 32 hours at 1000 °F. | 32 + 176 hours at 1000 °F. | 32 hours at 1100 °F. | 32 + 163 hours at 1100 °F. |
|---|---|---|---|---|---|
| 650 | 89 | 101 | 99 | 81 | 75 |
| 660B | 89 | 98 | 94 | 83 | 66 |
| 661 | 92 | 97 | 95 | 86 | 72 |
| 675 | 86 | 98 | 94 | 84 | 66 |
| 663 | 90 | 100 | 92 | 76 | 69 |
| 665 | 90 | 97 | 93 | 78 | 71 |
| 666 M-42 | 90 | 97 | 90 | 78 | 67 |

Examination of samples from cast ingots on a scanning electron microscope revealed the presence of dark spots in the core of some of the niobium carbide particles. EDS examination of these niobium carbides showed the dark spots were titanium. Titanium had not been included in the original factorial in order to keep the number of variables limited. It is well known that titanium acts as a nucleation agent for niobium carbide particles. The formation of titanium carbide is more favored as measured by free energy than niobium carbide at elevated temperatures. Additionally, titanium carbide has the same crystal structure as niobium carbide which allows the particles to be coherent to each other.

The original ingots were examined for titanium content which was picked up apparently as a contaminant from some of the raw materials used to make up the trial ingots.

Titanium Levels in Initial Melts

| Heat | Titanium | Heat | Titanium | Heat | Titanium |
|---|---|---|---|---|---|
| 645 | .010% | 654B | .027% | 663 | .014% |
| 646 | .023 | 655A | .023 | 664 | .018 |
| 647 | .010 | 656 | .022 | 665 | .012 |
| 648 | .023 | 657 | .004 | 666 | .008 |
| 649 | .020 | 658 | .005 | 673 | .011 |
| 650 | .020 | 659 | .002 | 674 | .007 |
| 651 | .020 | 660 | .003 | 675 | .007 |
| 652 | .021 | 661 | .012 | 676 | .013 |
| 653A | .011 | 662 | .014 | 677 | .015 |
| | | | | 678 | .012 |

A second set of melts were made involving a factorial around the heats with good hardenability and high retained hardness, heats 650, 660, 661 and 675, using different levels of aluminum and titanium. These heats are basically AISI M-2 with a low niobium content modified with varying amounts of aluminum and titanium. Two additional high niobium heats were melted because of the promising results on the initial melts of 663 and 665. Heat 663 is basically AISI M-1 with 1.5% niobium plus aluminum.

The 5" round ingots were pressed to 2.25" squares which were then rolled to 0.520" round bars. Samples were tested for composition and heat treat response.

Chemical Composition of Second Factorial Experimental Design Melts

| Melt | C | W | V | Mo | Al soluble | Nb | Ti | Si | Cr |
|---|---|---|---|---|---|---|---|---|---|
| 505 | 1.11 | 6.37 | 1.74 | 5.12 | .023 | .11 | .005 | .39 | 3.83 |
| 511 | 1.11 | 6.25 | 1.66 | 5.03 | .033 | .10 | .030 | .40 | 3.79 |
| 513 | 1.12 | 6.20 | 1.73 | 5.08 | .094 | .10 | .005 | .42 | 3.95 |
| 509 | 1.16 | 6.53 | 1.75 | 5.27 | .093 | .11 | .025 | .40 | 3.78 |
| 507 | 1.12 | 6.24 | 1.74 | 5.08 | .102 | .11 | .040 | .40 | 3.79 |
| 514 | 1.07 | 6.22 | 1.59 | 5.06 | .730 | .059 | .026 | .39 | 3.77 |
| 1043 | 1.00 | 5.53 | .82 | 7.00 | .139 | .31 | .033 | .40 | 3.86 |
| 1044 | 1.03 | 2.05 | .92 | 9.05 | .149 | .99 | .029 | .37 | 3.83 |

Samples from each melt were hardened in salt then tempered in air with two hours for each cycle.

Heat Treat Response of Second Factorial Melts Hardness HRC

| Heat | Austenitizing Temperature ° F. | As Quenched | 977F Temper 2 + 2 | 977F Temper 2 + 2 + 2 | 1043F Temper 2 + 2 | 1043F Temper 2 + 2 + 2 | 1112F Temper 2 + 2 | 1112F Temper 2 + 2 + 2 |
|---|---|---|---|---|---|---|---|---|
| 505 | 2140 | 63.77 | 66.9 | 66.5 | 65.2 | 65.8 | 64.8 | 63.9 |
| | 2170 | 62.78 | 67.3 | 67.2 | 64.2 | 66.5 | 65.0 | 64.6 |
| | 2200 | 62.98 | 66.8 | 67.3 | 65.0 | 67.0 | 65.2 | 65.1 |
| 507 | 2140 | 63.9 | 66.2 | 66.6 | 65.2 | 66.7 | 64.2 | 63.4 |
| | 2170 | 62.9 | 67.1 | 67.2 | 66.2 | 66.8 | 65.4 | 64.6 |
| | 2200 | 63.00 | 67.3 | 67.7 | 65.0 | 66.9 | 65.7 | 65.3 |
| 509 | 2140 | 62.4 | 67.0 | 67.0 | 64.3 | 66.6 | 65.5 | 64.5 |
| | 2170 | 61.6 | 67.3 | 67.5 | 64.0 | 66.4 | 65.7 | 65.3 |
| | 2200 | 61.9 | 67.6 | 67.7 | 64.3 | — | 65.8 | 65.7 |
| 511 | 2140 | 63.3 | 66.5 | 66.4 | 64.0 | 66.2 | 63.8 | 63.3 |
| | 2170 | 63.3 | 66.4 | 66.3 | 65.0 | 66.6 | 65.1 | 64.3 |
| | 2200 | 62.37 | 67.3 | 67.7 | 65.0 | 66.1 | 65.5 | 64.8 |
| 513 | 2140 | 63.7 | 62.8 | 64.7 | 66.5 | 65.5 | 65.0 | 63.7 |
| | 2170 | 63.6 | 67.1 | 67.2 | 64.8 | 66.7 | 65.4 | 64.8 |

-continued

| Heat | Austenitizing Temperature ° F. | As Quenched | 977F Temper 2 + 2 | 977F Temper 2 + 2 + 2 | 1043F Temper 2 + 2 | 1043F Temper 2 + 2 + 2 | 1112F Temper 2 + 2 | 1112F Temper 2 + 2 + 2 |
|---|---|---|---|---|---|---|---|---|
| | 2200 | 62.38 | 67.3 | 67.5 | 67.2 | 67.2 | 64.7 | 64.6 |
| 514 | 2140 | 63.6 | 66.4 | 66.9 | 65.1 | 66.5 | 64.0 | 63.0 |
| | 2170 | 62.9 | 67.1 | 67.2 | 65.2 | 66.6 | 65.4 | 64.4 |
| | 2200 | 62.96 | 67.2 | 67.5 | 65.5 | 66.8 | 65.8 | 63.0 |
| 1043 | 2100 | 62.46 | 66.15 | 63.88 | 63.5 | 65.9 | 64.0 | 63.6 |
| | 2140 | 61.58 | 66.7 | 66.9 | 63.4 | 65.7 | 64.8 | 65.6 |
| | 2170 | 60.52 | 66.5 | 67.1 | 62.3 | 65.0 | 66.6 | 66.3 |
| | 2200 | 59.38 | 66.57 | 66.8 | 63.8 | 65.0 | 65.7 | 65.6 |
| 1044 | 2100 | 64.9 | 65.6 | 66.0 | 65.1 | 66.2 | 63.3 | 62.7 |
| | 2140 | 64.3 | 66.3 | 66.3 | 65.5 | 66.4 | 64.1 | 63.8 |
| | 2170 | 63.48 | 67.1 | 66.9 | 65.4 | 66.9 | 64.6 | 64.0 |
| | 2200 | 62.7 | 67.0 | 66.8 | 66.1 | 66.9 | 63.5 | 62.4 |

Other bar samples were hardened and tempered then given aging treatments to measure resistance to softening in service.

Aging Trials: Percent Retained Hardness HRC

| Melt | Quench & Tempered Hardness - HRC | Hardness Retained after 1024 hours at 991 °F. | Hardness Retained after 1024 hours at 1101 °F. |
|---|---|---|---|
| 505 | 66.57 | 92.53% | 62.64% |
| 507 | 66.62 | 91.71 | 62.29 |
| 509 | 66.80 | 92.07 | 62.72 |
| 511 | 66.55 | 92.41 | 62.81 |
| 513 | 66.47 | 92.07 | 62.28 |
| 514 | 66.61 | 92.93 | 62.15 |
| 1043 | 66.66 | 92.86 | 64.35 |
| 1044 | 66.56 | 90.29 | 63.40 |
| A0333 M-42 | 66.50 | 89.32% | 64.96% |

Additional samples from these melts were hardened and tempered before being tested at elevated temperatures for hot hardness.

Hot Hardness Second Factorial Melts

Hardness—HRC and Percent of Initial Hardness Retained

| Melt | Room Temperature HRC | 900° F. HRC % | 1000° F. HRC % | 1100° F. HRC % | 1200° F. HRC % |
|---|---|---|---|---|---|
| 505 | 65.8 | 58.8 | 56.0 | 52.6 | 43.9 |
| | | 89.4 | 85.1 | 79.9 | 66.7 |
| 507 | 65.6 | 57.5 | 55.5 | 51.3 | 41.5 |
| | | 87.7 | 84.6 | 78.2 | 63.3 |
| 509 | 65.1 | 56.0 | 56.5 | 53.6 | 43.9 |
| | | 86.0 | 86.8 | 82.3 | 67.3 |
| 511 | 65.9 | 57.5 | 55.3 | 52.1 | 42.2 |
| | | 87.3 | 83.9 | 79.1 | 64.0 |
| 513 | 67.4 | 53.4 | 56.4 | 52.8 | 44.3 |
| | | 86.6 | 83.7 | 78.3 | 65.7 |
| 514 | 66.5 | 58.2 | 56.1 | 52.8 | 43.9 |
| | | 87.5 | 84.4 | 79.4 | 66.0 |
| 1043 | 66.6 | 57.9 | 55.2 | 52.3 | 43.2 |
| | | 86.9 | 82.9 | 78.5 | 64.9 |
| 1044 | 67.0 | 58.3 | 56.7 | 53.9 | 43.5 |
| | | 87.0 | 84.6 | 80.4 | 64.9 |

-continued

| Melt | Room Temperature HRC | 900° F. HRC % | 1000° F. HRC % | 1100° F. HRC % | 1200° F. HRC % |
|---|---|---|---|---|---|
| A0333 | 67.0 | 59.0 | 57.6 | 54.7 | 45.2 |
| M-42 | | 88.1 | 86.0 | 81.6 | 67.5 |

Longitudinal and transverse sections of annealed samples were examined using an optical microscope and 100× and 400×. The low niobium heats with higher titanium levels showed a tendency toward thicker banding of the carbides. The highest aluminum heat, 507, showed much larger carbides with heavy banding. Therefore, a larger heat based on the 509 analysis was scheduled. A semi-production heat of high niobium was based on the results of 1043 melt. However, based on relating of high aluminum levels with larger carbides in the annealed condition, the aluminum aim was lowered.

Chemical Composition Weight Percent Initial Semi-Production Heats

| | Chemical Composition Weight Percent Initial Semi-Production Heats | | | | | | |
|---|---|---|---|---|---|---|---|
| | C | W | Si | V | Cr | Mn | Co |
| aim low niobium | 1.08 | 6.25 | .39 | 1.75 | 3.80 | .32 | DNA |
| actual G3643 | 1.07 | 6.34 | .40 | 1.80 | 3.92 | .41 | .28 |
| aim high niobium | 1.08 | 4.50 | .32 | 1.00 | 3.80 | .32 | DNA |
| actual G3644 | 1.07 | 4.74 | .34 | 1.03 | 3.95 | .38 | .19 |

| | Mo | Al soluble | Nb | Ti | N | S | P |
|---|---|---|---|---|---|---|---|
| aim low niobium | 5.10 | .095 | .10 | .025 | .0325 | .005 | .015x |
| actual G3643 | 5.17 | .032 | .10 | .024 | .0408 | .011 | .021 |
| aim high niobium | 6.87 | .095 | .50 | .025 | .0325 | .005 | .015x |
| actual G3644 | 7.44 | .047 | .30 | .025 | .0370 | .007 | .022 |

The initial low niobium heat was set to be 0.06% in carbon below stoichiometric balance with the carbides while the actual heat is 0.09% below balance. The high niobium heat was aimed to be 0.01% deficient in carbon from stoichiometric balance but the final product was 0.04% deficient. Although the molybdenum level in the high niobium heat was above the aim, the molybdenum to tungsten ratio was essentially unchanged. The aim on the soluble aluminum content was missed substantially on both heats, but processing to wrought bar and testing were continued.

The ¾ ton ingots were slow cooled then given a subcritical stress relief at 1360° F., then rotary forged to 4.9375" round comer squares which were further rolled, then machined to a variety of bar sizes from 0.500 to 2.107" rounds. Hot acid macro examination of the billets from both heats showed excellent freedom from segregation and pattern at all locations from product of both heats. Bar samples were then tested for heat treat response, hot hardness, etc.

Optical microscope examination revealed typical primary carbides in large colonies in the as-cast material with the general carbide distribution growing finer as the material was hot worked. However, the primary carbide particles in the high niobium heat, G3644, larger and more squarish in shape. Examination of the material in the hardened and tempered condition showed some of the primary carbides in the heat G3644 at three way grain boundaries. The larger carbide particles in the high niobium heat are attributed to not only the higher niobium content but the relative lower amounts of aluminum and titanium in this heat that are available to nucleate fine particles and minimize their growth.

Bar samples of annealed material were hardened in salt, quenched, then tempered in air for two hours for each temper.

Heat Treat Response: Melt G3643 Hardness HRC

| Austenitize Temperature ° F. | As Quenched HRC | Temper ° F. | 1st Temper HRC | 2nd Temper HRC | 3rd Temper HRC | 4th Temper HRC |
|---|---|---|---|---|---|---|
| 2120 | 64.7 | 977 | 64.3 | 66.0 | 66.1 | 66.4 |
| 2140 | 64.0 | | 64.1 | 66.0 | 66.6 | 66.9 |
| 2200 | 63.1 | | 63.8 | 66.0 | 66.9 | 67.3 |
| 2240 | 62.9 | | 64.5 | 66.6 | 67.2 | 68.0 |
| 2180 | 64.0 | 1025 | — | — | — | 66.9 |
| 2120 | 64.7 | 1033 | 65.8 | 66.2 | 65.8 | 65.9 |
| 2140 | 64.0 | | 66.0 | 66.4 | 65.7 | 66.0 |
| 2160 | 63.8 | | 65.5 | 67.0 | 67.7 | 67.9 |
| 2200 | 63.1 | | 66.3 | 67.0 | 67.1 | 67.0 |
| 2240 | 62.9 | | 66.7 | 67.4 | 67.7 | 67.4 |
| 2120 | 64.7 | 1085 | 65.4 | 64.6 | 64.0 | 63.1 |
| 2140 | 64.0 | | 65.5 | 64.7 | 63.8 | 63.1 |
| 2160 | 63.8 | | 65.9 | 65.5 | 65.4 | 65.4 |
| 2200 | 63.1 | | 65.7 | 64.6 | 64.3 | 63.9 |
| 2240 | 62.9 | | 66.6 | 66.6 | 66.3 | 66.0 |

Heat Treat Response: Melt G3644 Hardness HRC

| Austenitize Temperature ° F. | AS Quenched HRC | Temper ° F. | 1st Temper HRC | 2nd Temper HRC | 3rd Temper HRC | 4th Temper HRC |
|---|---|---|---|---|---|---|
| 2140 | 62.6 | 977 | 63.3 | 65.2 | 65.7 | 66.4 |
| 2180 | 61.8 | | 63.0 | 64.5 | 66.0 | 66.5 |
| 2200 | 60.4 | | 61.9 | 64.7 | 65.9 | 66.4 |
| 2220 | 59.8 | | 62.0 | 64.7 | 65.2 | 66.2 |
| 2220 | 1025 | 1025 | — | — | — | 67.4 |

-continued

| Austenitize Temperature ° F. | AS Quenched HRC | Temper ° F. | 1st Temper HRC | 2nd Temper HRC | 3rd Temper HRC | 4th Temper HRC |
|---|---|---|---|---|---|---|
| 2130 | — | 1033 | 65.9 | 66.3 | 66.5 | — |
| 2140 | 62.6 | | 65.9 | 66.5 | 67.0 | 66.8 |
| 2160 | 61.7 | | 65.6 | 66.8 | 67.0 | 67.1 |
| 2180 | 61.8 | | 64.2 | 65.2 | 64.2 | 67.1 |
| 2200 | 60.4 | | 66.4 | 66.9 | 66.2 | 66.5 |
| 2220 | 59.8 | | 65.1 | 67.4 | 68.0 | 68.2 |
| 2140 | 62.6 | 1085 | 65.6 | 64.9 | 64.6 | 63.8 |
| 2160 | 61.7 | | 65.8 | 65.4 | 64.6 | 64.1 |
| 2180 | 61.8 | | 64.2 | 64.5 | 64.0 | 64.0 |
| 2200 | 60.4 | | 65.4 | 66.6 | 66.5 | 65.8 |
| 2220 | 59.8 | | 65.5 | 66.2 | 66.3 | 66.0 |

Bar samples from both heats were quenched and tempered, then aged at elevated temperature, 1128° F., then air cooled to room temperature to determine their retained hardness.

Percentage Retained Hardness—HRC of Initial Semi Production Heats Aged at 1128° F.

| Heat | Austenitization Temperature ° F. | initial HRC | at 194 hours HRC | % Re-tained | at 339 hours HRC | % Retained |
|---|---|---|---|---|---|---|
| G3643 | 2140 | 66.6 | 42.1 | 63.2 | 39.2 | 58.9 |
| | 2180 | 66.86 | 42.62 | 63.7 | 40.4 | 60.4 |
| G3644 | 2140 | 66.5 | 44.37 | 66.7 | 40.7 | 61.2 |
| | 2220 | 67.39 | 42.62 | 63.2 | 42.2 | 62.6 |

Additional samples from these melts were hardened and tempered before being tested at elevated temperatures for hot hardness.

Hot Hardness Initial Semi Production Heats

Hardness—HRC and Percent of Initial Hardness Retained

| Heat Austenitize Temperature | Room Temperature HRC | 900° F. HRC % | 1000° F. HRC % | 1100° F. HRC % | 1200° F. HRC % |
|---|---|---|---|---|---|
| G3643 | 66.1 | 56.5 | 52.6 | 47.1 | 22.7 |
| 2140F | | 85.5 | 79.5 | 71.3 | 34.3 |
| G3643 | 65.8 | 57.5 | 53.8 | 48.1 | 32.4 |
| 2180F | | 87.3 | 81.7 | 73.1 | 49.3 |
| G3644 | 66.1 | 56.6 | 54.5 | 48.5 | 32.5 |
| 2130F | | 85.2 | 82.4 | 73.3 | 49.2 |
| G3644 | 67.9 | 58.7 | 55.4 | 51.1 | 37.2 |
| 2220F | | 86.5 | 81.6 | 75.3 | 54.8 |
| M-42 | 67.3 | 57.5 | 55.9 | 50.1 | 34.8 |
| A0333 | | 85.8 | 83.1 | 74.4 | 51.7 |
| 2150F | | | | | |

Because the first set of semi production heats was slightly out of the desired chemical analysis, two additional heats were melted. The low niobium composition was tried again with higher aluminum. The higher niobium type was modified to have lower tungsten with higher molybdenum, niobium and aluminum. In essence, this high niobium heat was designed to mimic some of the alloy balances in AISI M-42. In particular, the ratio of vanadium plus niobium and titanium to the total tungsten and molybdenum is similar to M-42. Likewise, the ratio of molybdenum to molybdenum plus tungsten is the same as M-42. The aimed stoichiometric balance is also similar to M-42 while the total atomic fraction of carbide forming elements is the same.

Chemical Composition Weight Percent Second Set Semi-Production Heats

| | C | W | Si | V | Cr | Mn | Co |
|---|---|---|---|---|---|---|---|
| aim low niobium | 1.08 | 6.25 | .39 | 1.75 | 3.80 | .32 | DNA |
| actual G3845 | 1.06 | 6.17 | .32 | 1.77 | 3.91 | .56 | .26 |
| aim high niobium | 1.10 | 2.00 | .32 | .90 | 3.80 | .32 | DNA |
| actual G3846 | 1.10 | 2.19 | .50 | 1.11 | 3.82 | .41 | .12 |

| | Mo | Al soluble | Nb | Ti | N | S | P |
|---|---|---|---|---|---|---|---|
| aim low niobium | 5.10 | .095 | .10 | .025 | .0325 | .005 | .015x |
| actual G3845 | 4.97 | .100 | .097 | .027 | .0474 | .003 | .023 |
| aim high niobium | 9.00 | .14 | .90 | .025 | .0375 | .005 | .015x |
| actual G3846 | 9.07 | .116 | .80 | .034 | .0306 | .019 | .018 |

The second low niobium heat was set to be 0.06% in carbon below stoichiometric balance required to form known precipitates with alloy carbide formers and the actual heat was close to that aim with a carbon content just 0.08% below balance. The high niobium heat was aimed to be 0.07% deficient in the carbon necessary to meet the need for carbon to form a stoichiometric balance with the alloy carbide formers but the final product was 0.10% deficient. However the carbon necessary to combine with the primary, MC, type carbide formers such as VC, TiC, and NbC was 0.03 % more than in the aim chemistry.

The ¾ ton ingots were rotary forged to 4.9375" round corner squares which were further hot rolled then machined to final bar in sizes from 0.500 to 2.107" rounds. Hot acid macro examination of the billets from both heats showed excellent freedom from segregation and pattern at all locations from products of both heats. Bar samples were then tested for heat treat response, hot hardness, etc.

Bar samples from both heats of annealed material were hardened in salt, quenched, then tempered in air for two hours for each cycle.

Heat Treat Response: Melt G3845: Low Niobium Hardness HRC

| Austenitize Temperature ° F. | As Quenched HRC | Temper ° F. | 1st Temper HRC | 2nd Temper HRC | 3rd Temper HRC | 4th Temper HRC |
|---|---|---|---|---|---|---|
| 2120 | 64.3 | 979 | 64.3 | 65.4 | 66.3 | 66.6 |
| 2140 | 64.1 | | 64.5 | 65.6 | 66.1 | 66.2 |
| 2160 | 63.6 | | 64.4 | 65.8 | 66.6 | 66.5 |
| 2200 | 62.0 | | 63.5 | 65.2 | 66.6 | 66.7 |
| 2240 | 61.8 | | 63.9 | 66.1 | 66.9 | 67.3 |
| 2250 | 61.2 | | 64.4 | 66.0 | 67.0 | 67.5 |

-continued

| Austenitize Temperature ° F. | As Quenched HRC | Temper ° F. | 1st Temper HRC | 2nd Temper HRC | 3rd Temper HRC | 4th Temper HRC |
|---|---|---|---|---|---|---|
| 2120 | 64.3 | 1033 | 66.0 | 65.7 | 65.2 | 65.3 |
| 2140 | 64.1 | | 66.0 | 63.8 | 65.5 | 65.1 |
| 2160 | 63.6 | | 66.1 | 66.1 | 66.7 | 65.7 |
| 2180 | 63.2 | | 65.5 | 66.0 | 65.7 | — |
| 2200 | 62.0 | | 66.3 | 67.0 | 65.9 | 66.7 |
| 2240 | 61.8 | | 66.6 | 67.3 | 67.5 | 67.6 |
| 2250 | 61.2 | | 66.8 | 67.7 | 67.6 | 67.6 |
| 2200 | 62.0 | 1060 | 66.2 | 66.1 | 66.0 | 65.9 |
| 2240 | 61.8 | | 66.3 | 66.3 | 56.9 | 66.0 |
| 2250 | 61.2 | | 66.4 | 66.6 | 66.6 | 66.3 |
| 2120 | 64.3 | 1085 | 65.0 | 63.8 | 63.2 | 63.0 |
| 2140 | 64.1 | | 65.1 | 64.0 | 63.7 | 63.2 |
| 2160 | 63.6 | | 65.4 | 64.5 | 64.1 | 63.9 |
| 2200 | 62.0 | | 65.9 | 65.4 | 65.5 | 64.7 |
| 2240 | 61.8 | | 66.2 | 66.0 | 65.9 | 65.6 |
| 2250 | 61.2 | | 66.7 | 66.6 | 66.3 | 66.1 |
| 2200 | 62.0 | 1099 | 66.7 | 65.0 | 64.5 | 64.4 |
| 2250 | 61.2 | | 66.5 | 65.9 | 65.6 | 65.2 |

Heat Treat Response: Melt G3846 High Niobium Hardness HRC

| Austenitize Temperature ° F. | AS Quenched HRC | Temper ° F. | 1st Temper HRC | 2nd Temper HRC | 3rd Temper HRC |
|---|---|---|---|---|---|
| 2120 | 64.4 | 979 | 64.3 | 65.2 | 64.5 |
| 2140 | 64.3 | | 63.9 | 64.0 | 64.1 |
| 2160 | 65.2 | | 65.0 | 65.6 | 65.6 |
| 2180 | 63.6 | | 63.8 | 64.4 | 65.1 |
| 2200 | 64.4 | | 65.1 | 65.9 | 65.7 |
| 2220 | 64.2 | | 65.2 | 66.1 | 67.1 |
| 2240 | 64.1 | | 65.5 | 66.2 | 66.5 |
| 2260 | 63.3 | | 64.9 | 64.8 | 65.0 |
| 2120 | 63.5 | 1033 | 62.0 | 62.0 | 61.1 |
| 2140 | 65.0 | | 64.8 | 64.8 | 64.2 |
| 2160 | 65.2 | | 64.8 | 64.8 | 64.4 |
| 2180 | 64.5 | | 65.1 | 65.1 | 65.1 |
| 2200 | 64.7 | | 65.2 | 65.2 | 65.0 |
| 2220 | 64.1 | | 65.7 | 65.7 | 65.9 |
| 2240 | 64.1 | | 65.9 | 65.9 | 65.7 |
| 2260 | 63.3 | | 66.1 | 66.1 | 66.0 |
| 2120 | 64.0 | 1085 | — | 57.4 | 53.2 |
| 2140 | 65.0 | | 63.4 | 63.1 | 62.6 |
| 2160 | 64.9 | | 63.4 | 63.5 | 63.2 |
| 2180 | 64.7 | | 63.4 | 63.7 | 63.0 |
| 2200 | 64.4 | | 63.9 | 64.0 | 63.3 |
| 2220 | 64.1 | | 64.5 | 64.2 | 63.5 |
| 2240 | 63.5 | | 64.2 | 64.0 | 63.6 |
| 2260 | 64.2 | | 64.1 | 64.2 | 63.3 |

Bar samples from heat G2845 were hardened and tempered and given aging treatments to measure resistance to softening in cutting operations.

Bar samples from heat G3845 were hardened and tempered and given aging treatments to measure resistance to softening in cutting operations.

Percentage Retained Hardness—HRC of G3845 Low Niobium Heat Aged at 1128° F.

| Austenitization Temperature °F. | initial HRC | at 164 hours HRC | % Retained | at 335 hours HRC | % Retained |
|---|---|---|---|---|---|
| 2180 | 65.7 | 41.1 | 62.6 | 27.47 | 41.8 |
| 2240 | 66.8 | 43.1 | 64.5 | 30.74 | 46.0 |

Additional samples from heat G3845 were hardened and tempered then tested at elevated temperatures for hot hardness.

Hot Hardness G3845 Low Niobium Heat Hardness—HRC and Percent of Initial Hardness Retained

| Austenitize Temperature | Room Temperature HRC | 900° F. HRC % | 1000° F. HRC % | 1100° F. HRC % | 1200° F. HRC % |
|---|---|---|---|---|---|
| 2180 | 66.0 | 57.0 | 52.3 | 48.8 | 35.5 |
| | | 86.4 | 79.2 | 73.9 | 53.8 |
| 2240 | 66.8 | 57.6 | 56.4 | 51.1 | 38.9 |
| | | 86.2 | 84.4 | 76.5 | 58.2 |

While several embodiments have been shown and described, it should be recognized that other variations and/or modifications not described herein are possible without departing from the spirit and scope of the present invention.

We claim:

1. An alloy steel consisting essentially of by weight about 0.75 to 1.25% carbon, 0.3 to 1.35% manganese, 0.036 to 0.300% sulphur, less than 0.04% phosphorous, 0.1 to 0.7% silicon, 3.25 to 5% chromium, 5.25 to 12% molybdenum, less than 0.5% cobalt, 0.5 to 1.75% vanadium, 0.5 to 5% tungsten, 0.03 to 1.25% aluminum, 0.15 to 2.5 niobium, 0.25 to 2.5% zirconium, 0.3 to 4.75% tantalum, and 0.015 to 0.1% titanium, balance substantially iron.

2. The alloy steel of claim 1 wherein the alloy is treated in a liquid state with up to 0.05 wt. % of magnesium or calcium.

3. An alloy steel consisting essentially of by weight about 0.7 to 1.4% carbon, up to 1% manganese, less than 0.04% phosphorous, less than 0.7% silicon 3 to 6% chromium, 4 to 12% molybdenum, less than 0.5% cobalt, 0.75 to 2.25% vanadium, 1 to 7% tungsten, 0.03 to 1.25% aluminum, 0.25 to 2% niobium, and 0.015 to 0.07 % titanium, balance substantially iron.

4. The alloy steel of claim 3 containing about 0.75 to 1.2% carbon, 0.1 to 0.7% manganese, 0.1 to 0.6% silicon, 3.25 to 5% chromium, 4 to 10% molybdenum, 2 to 7% tungsten, 0.03 to 0.25% aluminum, and 0.015 to 0.05% titanium, balance substantially iron.

5. An alloy steel consisting essentially of by weight about 0.85 to 1.25% carbon, 0.1 to 0.7% manganese, less than 0.04% phosphorous, 0.1 to 0.7% silicon, 3.25 to 5% chromium, 5.25 to 12% molybdenum, less than 0.5% cobalt, 0.75 to 2.25 vanadium 3 to 7% tungsten, 0.03 to 1.25% aluminum, 0.25 to 2% niobium, and 0.015 to 0.07% titanium, balance substantially iron.

6. The alloy steel of claim 3 containing about 0.75 to 1.25% carbon, 0.1 to 0.7% manganese, 0.1 to 0.7% silicon, 3.25 to 5.0% chromium, 5.25 to 12.00% molybdenum, 0.75 to 1.75% vanadium, 1.0 to 5.0% tungsten, 0.03 to 1.25% aluminum, and 0.015 to 0.1 % titanium, balance substantially iron.

* * * * *

UNITED STATES PATENT AND TRADEMARK OFFICE

CERTIFICATE OF CORRECTION

PATENT NO. : 6,200,528 B1
DATED : March 13, 2001
INVENTOR(S) : Mark S. Rodney et al.

It is certified that error appears in the above-identified patent and that said Letters Patent is hereby corrected as shown below:

Column 1,
Line 16, "bainltic" should read -- bainitic --.

Column 4,
Second Table, fourth column heading, "Anstenite" should read -- Austenite --.
Second Table, Row 13, Column 4, "anstenite" should read -- austenite --.
Second Table, Row 16, Column 4, "anstenite" should read -- austenite --.

Column 5,
Line 5, continued Table, fourth column heading, "Anstenite" should read -- Austenite --.

Column 9,
Last Table, row Melt 513, third column, "53.4" should read -- 58.4 --.

Column 12,
Last Table, row M-42, third column, "57.5" should read -- 57.8 --.

Column 14,
Second table, last row, fourth column, "64.1" should read -- 64.3 --

Signed and Sealed this

Eleventh Day of December, 2001

*Attest:*

Nicholas P. Godici

*Attesting Officer*

NICHOLAS P. GODICI
*Acting Director of the United States Patent and Trademark Office*